United States Patent [19]

Wolfersperger

[11] Patent Number: 4,636,273

[45] Date of Patent: Jan. 13, 1987

[54] PROCESS FOR MANUFACTURING COVERS FOR CONTAINERS OPENED BY PEELING OFF THE COVER

[75] Inventor: Daniel J. Wolfersperger, Selestat, France

[73] Assignee: Societe Alsacienne D-Aluminium, Saint Julien en Genevois, France

[21] Appl. No.: 643,270

[22] Filed: Aug. 22, 1984

[30] Foreign Application Priority Data

Aug. 24, 1983 [FR] France ..... 83 13639

[51] Int. Cl.[4] ..... B32B 31/18

[52] U.S. Cl. ..... 156/244.11; 156/244.18; 156/252; 156/256; 220/260; 220/265; 220/266; 220/270; 220/276; 220/359

[58] Field of Search ..... 156/244.11, 244.18, 156/252, 253, 256; 220/253, 260, 265, 266, 270, 276, 359

[56] References Cited

U.S. PATENT DOCUMENTS

| | | | |
|---|---|---|---|
| 3,393,118 | 7/1968 | Ekström | 156/252 |
| 4,020,969 | 5/1977 | Ando | 220/359 |
| 4,135,637 | 1/1979 | Hannula | 220/260 |
| 4,189,060 | 2/1980 | Trotman | 220/260 |
| 4,372,460 | 2/1983 | Brochman et al. | 220/260 |

*Primary Examiner*—Caleb Weston
*Attorney, Agent, or Firm*—Warren B. Kice

[57] ABSTRACT

A process for manufacturing covers intended to close containers which are opened by peeling off the cover, these covers being of a type comprising an orifice and two closure elements disposed on each side of the orifice which they close and in which they adhere to one another, characterized in that it consists:

in forming a series of holes (3) intended to form the orifices of the covers in a strip (2);

in applying to one of the faces of the perforated strip (2) a first continuous coating (4) intended to form one of the two closure elements, this first coating being separable at least partially from the strip (2) by peeling off;

in applying to the other face of the perforated strip (2) a second continuous coating (5) so that it comes into contact with the parts of the first coating (4) which are defined by the holes (3) and adheres strongly to these parts as well as to the perforated strip (2), this second coating (5) being intended to form the other closure element; and in cutting out the multi-layer sheet (1) thus formed so that the holes (3) are all situated in a cover (7).

15 Claims, 10 Drawing Figures

PROCESS FOR MANUFACTURING COVERS FOR CONTAINERS OPENED BY PEELING OFF THE COVER

The present invention relates to a process for manufacturing covers or lids for closing containers by peeling off the cover, such covers being of the type comprising an orifice and two closure elements disposed on each side of the orifice which they close and in which the adhere to one another.

Covers of this type have been designed for closing containers containing food products such as drinks or yoghurts. Those to be found at present on the market do not however give entire satisfaction. Positioning their closure elements requires in fact a great deal of time and results in relatively high manufacturing costs. Moreover, their internal closure element, namely the one intended to be on the same side as the product to be packed, is appreciably smaller than the inlet aperture of the container and does not always perfectly ensure its sealing function. In addition, it is often difficult to position on the orifice.

The present invention proposes overcoming these drawbacks, and, for this, it provides a process for manufacturing covers intended to close containers opened by peeling off the cover, this process being characterized in that it consists:

in forming a series of holes intended to constitute the orifices of the covers in a strip;

in applying to one of the faces of the perforated strip a first continuous coating intended to form one of the two closure elements, this first coating being separable at least partially from the strip by peeling off;

in applying to the other face of the perforated strip a second continuous coating so that it comes into contact with the parts of the first coating which are defined by the holes and adheres vigorously to these parts as well as to the perforated strip, this second coating being intended to form the other closure element; and in cutting out the multi-layer sheet thus formed so that the holes are all situated in a cover.

The manufacture of the covers may thus be entirely mechanized, which speeds up the production rates and consequently lowers the cost price of these covers. Furthermore, since the first and second coatings entirely cover the two faces of the covers, the containers may be perfectly sealed and the quality of the packed product does not risk deteriorating in time.

When at least one of the first and second coatings is used to form one of the faces of the multi-layer sheet, it may be advantageous to apply it by extrusion-lamination, counter bonding or paraffining.

On the other hand, when a multi-layer sheet is desired comprising more than three layers, at least one of the first and second coatings may be applied by sandwich extrusion between the perforated strip and an additional strip.

Advantageously, opening tabs may be formed between the perforated strip and the first coating, in zones situated along the cut-out lines of the multi-layer sheet.

With these opening tabs, the consumer has a better grip on the first coating and may then separate it more readily from the perforated strip. During this operation, the part of the second coating which is secured to the first coating will of course be torn off therewith, which then allows the consumer to have access to the contents of the container.

In a particular embodiment of the process of the invention, the opening tabs may be formed by creating non adherence zones on the strip, before applying the first coating, for example by applying a polysiloxane or polyamide based varnish or a nitrocellulosic ink on a helio or flexo printer.

In another particular embodiment of this process, the opening tabs may also be formed by making additional perforations in the strip, before applying the first and second coatings.

In the case where the second coating is covered by an additional strip, it may be desirable for this latter to be separable by peeling off. In fact, since the interface between the additional strip and the second coating is generally sterile, it will be sufficient to provide a sterile enclosure in which the additional strip may be peeled off, the containers filled and the covers sealed, (so that the second coating is turned towards the containers) in order to pack the product in a perfectly aseptic manner.

Other features and advantages of the present invention will be clear from the following description given by way of example with reference to the accompanying drawings in which.

Figure 1:
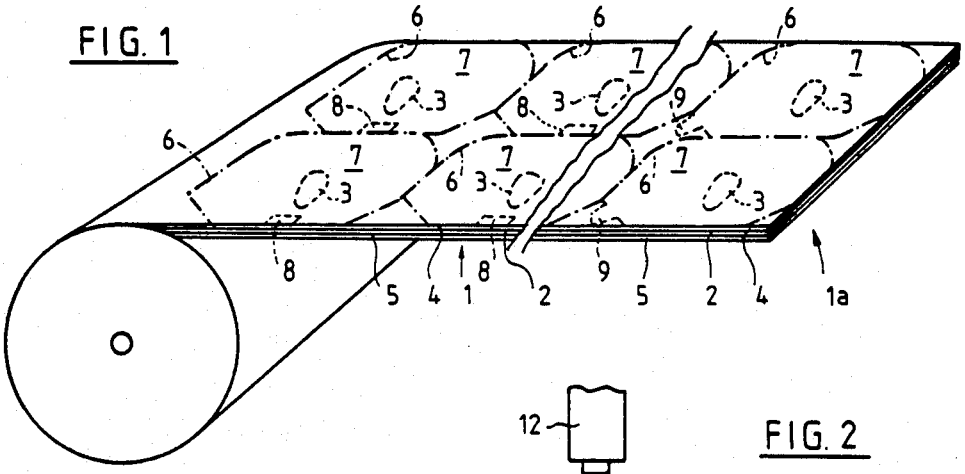
FIG. 1 is a schematical perspective view showing a reel formed by winding up a multi-layer sheet obtained during implementation of the process of the invention, as well as a section of another multi-layer sheet slightly different from the preceding one.

The multi-layer sheet 1 which is shown on the left in FIG. 1 is in the form of a reel so that it may have a length of several hundred linear meters.

In the embodiment shown in FIG. 1, sheet 1 is formed from three layers, namely an intermediate strip 2 pierced with hose 3 judiciously spaced from each other and two coatings 4, 5 applied to the upper and lower faces of the intermediate strip, these two coatings closing the holes 3 through which they adhere strongly to each other.

In some cases, sheet 1 could comprise more than three layers, coatings 4 and 5 being if required covered in their turn by a coating of one or more layers.

The intermediate strip 2 may have a thickness of the order of 15 to 200 microns (1.5 to $20.10^{-5}$ m) and be made from metal, more especially from aluminium or an aluminium alloy, from a cellulosic material such as paper, or a synthetic material such as polyvinylchloride, a polyester, a polypropylene, a polyethylene, a polyamide, a polybutylene etc.

The coatings 4, 5 may have a thickness of the order of 10 to 100 microns (1 to $10.10^{-5}$ m) and be made from a synthetic material such as a polyester, a polypropylene, a polyethylene, a polybutylene, a polyamide, an ethyleneacrylic acid copolymer, an ionomer resin, etc.

Coating 4, namely the one which is fixed to the upper face of the intermediate strip 2, is made from a material which has little affinity for this latter so as be able to be relatively easily separated therefrom by peeling off. On the other hand, coating 5 is made from a material which has great affinity with the intermediate strip and coating 4, so that it cannot be separated from these latter.

It will be noted here that when coatings 4 and 5 are themselves coated with an additional coating, this latter is preferably formed by a strip of aluminium coated if required on its external face with a layer of polyester, polypropylene, polyethylene, polybutylene, polyamide, ethylene-acrylic acid copolymer, ionomer resin, heat-bonding varnish, etc.

The multi-layer sheet 1 is intended to be cut along the closed lines 6 corresponding to the contour of the covers 7 to be formed. The location of these lines, as well as that of holes 3 of the intermediate strip 2, are of course chosen so that each cover comprises a hole 3 and so that the cutting out waste is as small as possible.

It will be noted that sheet 1 comprises, between the intermediate strip 2 and coating 4, non adherence zones 8 adjacent one of the sides of the cover 7. These zones are in fact provided so that the consumer, desiring to open a container closed by cover 7, may more easily grip the coating 4 so as to remove it without difficulty by peeling off.

Referring now to the sheet section 1*a* shown on the right of FIG. 1, it will be noted that the non adherhence zones 8 have been replaced by tongues 9 situated, not inside, but outside the covers. These tongues, whose purpose is also to facilitate peeling off of coating 4, are formed by piercing a second series of holes in the intermediate strip 2, coatings 4 and 5 again closing these other holes while adhering to one another therethrough.

Several techniques will now be described for applying one or more coatings to a perforated strip such as the intermediate strip 2 of sheets 1 and 1*a*.

Figure 2:
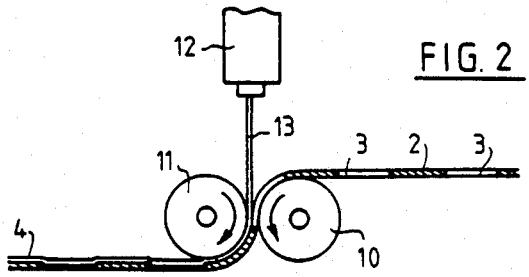
FIG. 2 is a schematical view of a machine for the extrusion-lamination of a coating on a perforated strip.

Referring first of all to FIG. 2 which illustrates the extrusion-lamination technique, it can be seen that the intermediate strip 2 travels between two rotary cylinders 10, 11 while a die 12 of conventional design delivers a viscous film 13 into the slit formed between the upper face of strip 2 and the downstream cylinder 11. Film 13, which is formed by a molten material intended to form coating 4, is driven slightly into holes 3 (and if required into the holes corresponding to tongues 9) of strip 2 as it passes between the two cylinders, then is cooled between two appropriate cylinders not shown.

It will be noted here that the non adherence zones 8 may be formed on the intermediate strip by impression of a varnish or an ink in a helio or flexo printer, before application of film 13.

Figure 3:
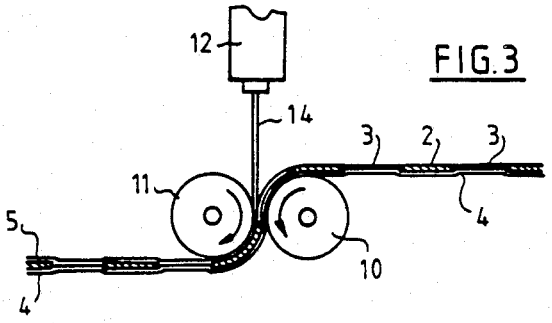
FIG. 3 is a view similar to FIG. 2 but showing the machine performing the extrusion-lamination of another coating on the other face of the strip.
Figure 4:
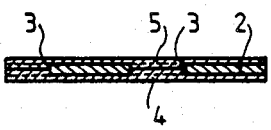
FIG. 4 is an enlarged sectional view of the multi-layer sheet shown in FIG. 3.

When coating 4 is deposited over the whole length of the intermediate strip, this latter is then turned over and again passed between cylinders 10 and 11, as shown in FIG. 3. The die 12, which now contains one of the materials used for forming coating 5, delivers a viscous film 14 into the slit formed between the face of strip 2 which is still bare and cylinder 11.

Film 14 is in its turn driven slightly into holes 3 (and holes 9 when they exist) as it passes between the cylinders 10, 11, which allows it to come into contact with coating 4 and to strongly adhere thereto, after which it is solidified between the cooling cylinders mentioned above.

Coatings 4 and 5 could of course be applied with the same machine equipped with two dies. Furthermore, so as to increase the adherence between one of the coatings and strip 2, for example at the periphery of holes 3 (and 9 if they exist), the corresponding face of the strip may be coated with an adherence promoter applied by a helio element integrated in the extruder, or said face may be treated by discharge, more especially by Corona discharge.

Figure 5:
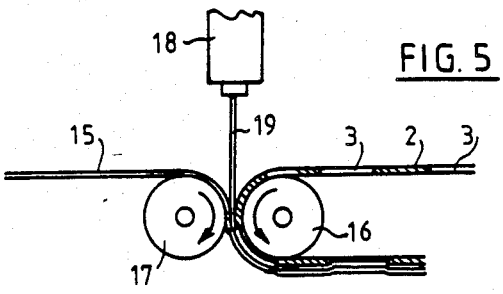
FIG. 5 is a schematical view of a machine for the sandwich extrusion of a coating between a perforated strip and an additional strip.

Referring now to FIG. 5, which illustrates the sandwich extrusion technique, it can be seen that strip 2 and an additional strip 15 pass between two rotary cylinders 16, 17, whereas a die 18 delivers a viscous film 19 into the slit formed between the two strips 2 and 15. Film 19, which is formed by a molten material, for example one of those used for forming coating 5, is driven slightly into holes 3 of strip 2 then cooled in a way known per se.

The material forming film 19 could have a great affinity for strip 2 and little affinity for the additional strip 15. In this case, the additional strip could in fact be peeled off from strip 2, thus laying bare a sterile surface.

Figure 6:
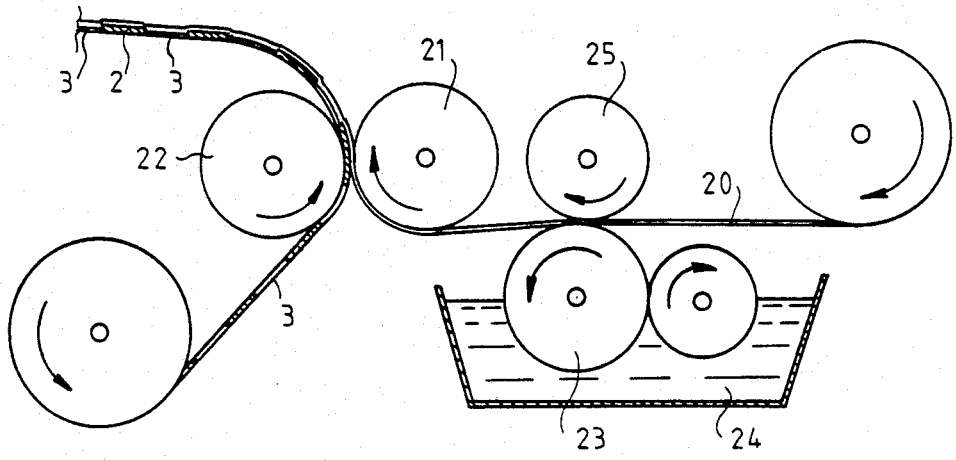
FIG. 6 is a schematical view of a machine for counter bonding an additional strip to one of the faces of a perforated strip.

Referring furthermore to FIG. 6, which illustrates the counter bonding technique, it can be seen that the perforated strip 2 and strip 20, made preferably from aluminium, pass between two rotary cylinders 21, 22. Before reaching cylinder 21, sheet 20 passes between a cylinder 23 dipped in a bath of bonding agent 24 and a presser cylinder 25.

Strip 20 is driven slightly into holes 3 when it passes between cylinders 21, 22 and adheres perfectly to strip 2 at the outlet of an appropriate drier (not shown) used for evaporating the water contained in the bonding agent.

In order to fix a second metal strip to the other face of strip 2, the installation shown in FIG. 6 could further be used. An installation could however be used for coating the second metal strip with a reactive bonding agent having at least two components, this installation then comprising driers for evaporating the solvents and heating cylinders for reactivating the bonding agent. An installation could also be used using bonding agents without solvents.

Figure 7:
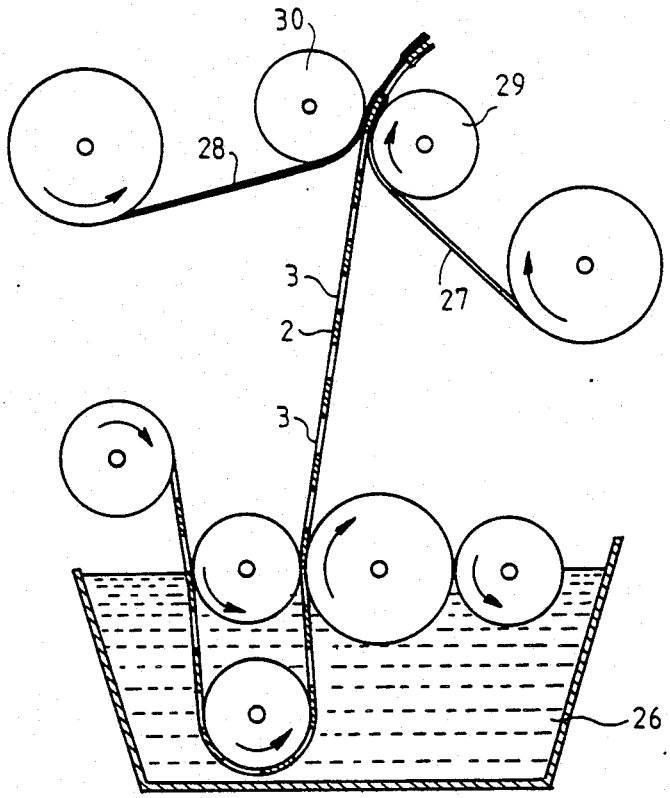
FIG. 7 is a schematical view of a machine for fixing an additional strip by paraffining to each of the faces of a perforated strip.

Referring now, to FIG. 7, which illustrates the paraffining technique, it can be seen that the perforated strip 2 travels through a wax or "hot melt" bath 26 in the molten state, before being sandwiched between two strips 27, 28, which may be metal or not, travelling between two rotary cylinders 29, 30. On leaving these latter, strips 27 and 28 adhere to one another in holes 3 (and holes 9 when they exist) whereas a cooling cylinder (not shown) is provided for hardening and solidifying the wax or the hot melt.

FIG. 7 shows an installation for simultaneously fixing the two strips 27, 28 to strip 2. It is obvious however that only one of the two strips 27 and 28 could be fixed by paraffining.

For forming multi-layer sheets 1 as shown in FIG. 1, the procedure is as follows:

holes 3, which are intended to form the orifices of cover 7, and holes 9 when they are required, are formed in strip 2, by means of a press or a rotary cut-out tool;

the non adherence zones are formed by printing a varnish or an ink on one of the faces of the perforated strip 2, by using a helio or flexo printer. Should coating 4 be transparent, the printer could also be used for forming decorative or advertising prints such as those shown at 31 in FIGS. 8 and 9; and coatings 4, 5 are applied to the two faces of the perforated strip:

by extrusion-lamination, as shown in FIGS. 2 and 3; or by sandwich extrusion, as shown in FIG. 5; or by counter bonding, as shown in FIG. 6; or by paraffining as shown in FIG. 7.

The technique used for applying coating 4 could of course be different from the one used for applying coating 5.

The multi-layer sheets 1 are delivered in reels to industrialists involved in packing products such as drinks or yoghurts.

Figure 8:
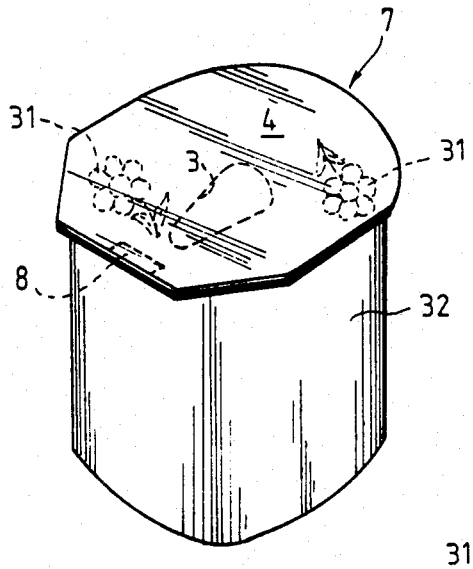
FIG. 8 is a perspective view showing a container closed by a cover obtained by using the process of the invention.
Figure 9:
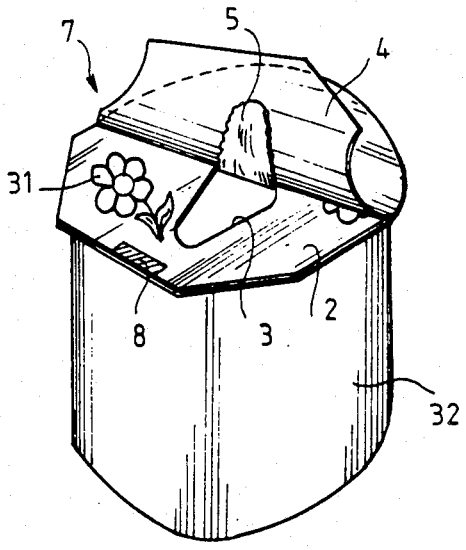
FIG. 9 is a perspective view of the container shown in FIG. 8, but during opening thereof.
Figure 10:
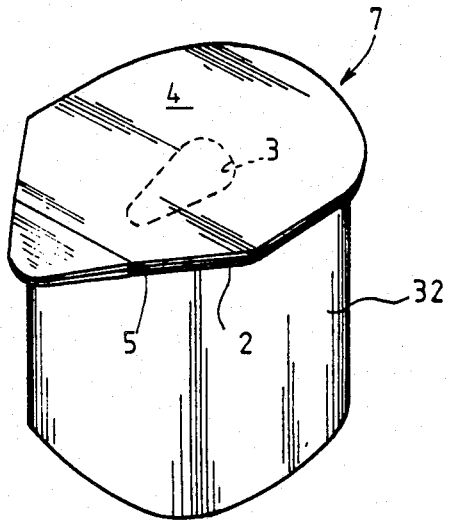
FIG. 10 is a perspective view of a container closed by another cover obtained by using the process of the invention.

To pack these products, these industrialists manufacture containers of the type shown at 32 in FIGS. 8 to 10, generally by heat-forming a plastic material strip, then fill the containers 32 with the product, fix the multi-layer sheet 1 or 1*a* (with coating 4 turned upwardly) by heat-sealing, crimping or ultra-sonic welding along the inlet aperture of the containers and cut-out sheet 1 or 1*a* along the lines 6 shown in FIG. 1, which correspond to the outer contour of the inlet aperture of the containers (and to that of tongues 9 in the case of sheet 1*a*).

To open a container such as the one shown in FIG. 8, the operator raises slightly the part of coating 4 which overhangs the non adherence zone 8, grips this part and pulls it upwardly until the part of coating 5 located in hole 3 is torn away as shown in FIG. 9.

In all the foregoing, it has been assumed that coating 4 could be entirely peeled off. It goes without saying however that an adherence promoter could be applied to strip 2 by helio or flexo printing, before application of coating 4, so as to prevent this latter from being separated from strip 2 when hole 3 is completely opened.

Sheets 1 or 1*a* could further be heated for a few minutes at a temperature higher than 100° C. so as to make them sterile and allow packing of products under perfectly aseptic conditions.

Finally, referring now to FIG. 10, it can be seen that the part of sheet 1, which corresponds to one of holes 9 in strip 2, forms a gripping tongue which the consumer may easily grip so as to separate coating 4 from strip 2 and tear away the part of coating 5 situated in hole 3.

It goes without saying that the present invention also relates to the covers obtained by using the above described process, as well as to the containers closed by such covers.

What is claimed is:

1. A process for manufacturing covers for containers which are opened by peeling off the cover, comprising the steps of forming a series of holes in a strip of material, applying a first continuous coating to one of the faces of the perforated strip, said first coating being at least partially separable from the strip by peeling off said coating, applying a second continuous coating to the other face of the perforated strip so that a portion of said second coating adheres to a corresponding portion of the first coating through said holes, the length and width of each of said coatings substantially corresponding to that of said strip, and cutting out the multi-layer sheet thus formed to form a series of covers, each having one hole.

2. The process according to claim 1 wherein at least one of said first and second coatings is applied to the perforated strip by extrusion-lamination.

3. The process according to claim 1 wherein said strip has a thickness of the order of 15 to 200 microns and is made from a material selected from the group consisting of aluminum, and aluminum alloy, polyvinylchloride, polyester, polypropylene, polyethylene, polybutylene, polyamide or paper.

4. The process according to claim 1 wherein said first and second coatings have a thickness of the order of 10–100 microns and are made from material selected from the group consisting of polyester, polypropylene, polyethylene, polybutylene, polyamide, ethylene-acrylic acid copolymer, or ionomer resin.

5. The process according to claim 1 further comprising the step of forming prints on said perforated strip before the first coating is applied.

6. The process according to claim 1 wherein at least one of the first and second coatings is applied to the perforated strip by counter bonding.

7. The process according to claim 1 wherein at least one of the first and second coatings is applied to the perforated strip by paraffining.

8. The process according to claim 1 wherein at least one of said first and second coatings is applied by sandwiching it between the perforated strip and an additional strip.

9. The process according to claim 8 wherein said additional strip is made from aluminum and is coated on its external face with a layer of a material selected from the group consisting of polyester, polypropylene, polyethylene, polybutylene, polyamide, ethylene-acrylic acid copolymer, ionomer resin or a heat-bonding varnish.

10. The process according to claim 8 wherein said additional strip is separable by peeling it off from said coating.

11. The process according to claim 10 wherein said additional strip is separated in a sterile enclosure, before the covers are fixed to their respective containers.

12. The process according to claim 1 wherein opening tabs are formed between the perforated strip and said first coating in zones situated on the cut out lines of the multi-layer sheet.

13. The process according to claim 12 wherein said opening tabs are formed by making additional perforations in the strip before application of the first and second coatings.

14. The process according to claim 12 wherein said opening tabs are formed by creating non adherence zones on the strip before application of said first coating.

15. The process according to claim 14 wherein said non adherence zones are created by application of a varnish or an ink.

* * * * *